US009352362B1

(12) United States Patent
Manninen et al.

(10) Patent No.: US 9,352,362 B1
(45) Date of Patent: May 31, 2016

(54) COMBINATION SPRAY AND IMMERSION PARTS WASHER

(75) Inventors: Kenneth J. Manninen, Fond du Lac, WI (US); Jeffery P. Brouchoud, Appleton, WI (US); Kevin L. Schmitz, Chilton, WI (US)

(73) Assignee: Alliance Manufacturing, Inc., Fond du Lac, WI (US)

( * ) Notice: Subject to any disclaimer, the term of this patent is extended or adjusted under 35 U.S.C. 154(b) by 1268 days.

(21) Appl. No.: 12/914,213

(22) Filed: Oct. 28, 2010

Related U.S. Application Data

(60) Provisional application No. 61/256,783, filed on Oct. 30, 2009.

(51) Int. Cl.
*B08B 3/04* (2006.01)
*B08B 13/00* (2006.01)

(52) U.S. Cl.
CPC .. *B08B 3/04* (2013.01); *B08B 13/00* (2013.01)

(58) Field of Classification Search
CPC ..... B08B 3/02; B08B 3/042; B08B 3/04; B08B 3/06; B08B 3/14
USPC ..... 134/111, 200, 186, 10, 104.4, 113, 117, 134/155, 105, 108, 184, 58 DL
See application file for complete search history.

(56) References Cited

U.S. PATENT DOCUMENTS

| | | | | |
|---|---|---|---|---|
| 2,570,021 | A | 10/1951 | Beach | |
| 2,664,902 | A | 1/1954 | Campion | |
| 3,158,160 | A | 11/1964 | Estandian | |
| 3,522,814 | A * | 8/1970 | Olson | 134/111 |
| 4,128,478 | A | 12/1978 | Metzger | |
| 4,509,545 | A | 4/1985 | Trotter | |
| 5,213,117 | A | 5/1993 | Yamamoto | |
| 5,220,933 | A | 6/1993 | Albers | |
| 5,368,653 | A | 11/1994 | Russell | |
| 5,464,033 | A | 11/1995 | Hartnell | |
| 5,482,064 | A | 1/1996 | Goddard | |
| 5,598,861 | A | 2/1997 | Danowski et al. | |
| 6,199,565 | B1 * | 3/2001 | Bluestone | 134/108 |
| 2007/0006921 | A1 * | 1/2007 | Hoeptner | 137/315.12 |
| 2008/0210276 | A1 * | 9/2008 | Porter et al. | 134/198 |
| 2009/0023973 | A1 * | 1/2009 | Lowery et al. | 588/252 |

* cited by examiner

*Primary Examiner* — David Cormier
*Assistant Examiner* — Irina Graf
(74) *Attorney, Agent, or Firm* — Brannen Law Office, LLC

(57) ABSTRACT

The invention has a container that can be a drum of standard size with a drum cover. The cover can have a closable lid secured with a latch, and can have an open lid safety switch. A control assembly adjacent the lid is provided. A solution level gauge and a low fluid shutoff are also provided. Internally, there can be an upper chamber and a lower chamber. The upper chamber is a dual use spray and immersion chamber, and can have spray manifolds therein. The lower chamber is a reservoir chamber that can, but is not required to, house a submersible pump and a heater. A seal can be provided between the upper and lower chambers. The assembly can be removed as a single unit or in segments from the container for cleaning and maintenance.

17 Claims, 5 Drawing Sheets

COMBINATION SPRAY AND IMMERSION PARTS WASHER

PRIORITY CLAIM

This United States utility patent application claims priority on and the benefit of provisional application 61/256,783 filed Oct. 30, 2009, the entire contents of which are hereby incorporated herein by reference.

BACKGROUND OF THE INVENTION

1. Field of the Invention

The present invention relates to a combination spray and immersion parts washer with multiple chambers within one container.

2. Description of the Related Art

Industrial parts cleaners and washers are not new. In fact, there have been many designs over the years. Some examples of existing assemblies include:

U.S. Pat. No. 5,220,933 to Albers is titled Cleaning Tank. The Albers patent shows a cleaning tank having a fluid container, an air driven motor, a drive shaft, a filtered submersible pump, fluid transport conduits, outlet nozzles and workpiece supports.

U.S. Pat. No. 5,464,033 to Hartnell is titled Hot Solvent Cleaning Tank. The Hartnell patent shows a hot solvent cleaning tank for cleaning parts. An open top steel barrel is mounted on casters and provided with a thermostatically controlled heating element. A pump is provided, but is located outside of the barrel. A basket can be suspended by a chain hooked on the barrel rim above the solvent level. The tank system is described in Colum 3, Lines 34-39 to be used as both an immersion cleaner and a recirculation parts cleaner.

U.S. Pat. No. 5,368,653 to Russell is titled Parts Washer for Cleaning Mechanical Parts. The Russell patent describes a parts washer for cleaning parts comprising a tank mounted upon a reservoir. A pump draws liquid cleaning solvent from the reservoir and circulates the liquid cleaning solvent into the sink and back into the reservoir. A filter is shown to be between the sink and the reservoir.

U.S. Pat. No. 2,570,021 to Beach is titled Parts Cleaning Machine. The Beach patent shows a machine to clean parts by treating the parts with sprays projected from different directions. A screen is provided over a dome shaped bottom. A spray ring is also provided.

Other examples include:

| U.S. Pat. No. | Inventor | Title |
|---|---|---|
| 5,598,861 | Danowski et al. | Parts Washer with Solvent Flow Control |
| 5,482,064 | Goddard | Cleaning Apparatus |
| 5,213,117 | Yamamoto | Parts Washer |
| 4,509,545 | Trotter | Portable Washing and Spray Assembly |
| 4,128,478 | Metzger | Parts Washer |
| 3,158,160 | Estandian | Portable Dish Washer |
| 2,664,902 | Campion | Center Spray Portable Dishwashing Machine |

While each may work well for their respective intended purposes, they each may be improved upon.

Notably, none of these references show a container having two chambers within a single unitary container.

Further, having two chambers within a single conventional 55 gallon drum is not shown, nor is the method of making such an assembly.

Still further, it is desired to have an improved overflow device for maintaining proper solution level in upper chamber during immersion cleaning.

Still further yet, it is desired to have a solution soak cycle control for controlling solution level for immersion cleaning in upper chamber.

Still further yet, it is desired to have a closable lid to contain spray.

Still further yet, it is desired to have a safety switch that automatically stops spraying if the lid were opened during operation.

Still further yet, it is desired to have a low fluid shutoff, whereby pump and heat would be shut-off in a low fluid situation to prevent damage to the machine.

Still further yet, it is desired to be able to fully and easily remove the internal parts from the container for cleaning and maintenance.

Still further yet, it is desired to have a seal that affords a suitable seal between the top and bottom chambers during operation, yet allows for easy installation and removal of the assembly into and from the container.

Thus there exists a need for a combination spray and immersion parts washer that solves these and other problems.

SUMMARY OF THE INVENTION

The present invention relates to a combination spray and immersion parts washer with multiple chambers within one container. In one embodiment, the invention has a container that can be of standard size with a drum cover. The cover can have a closable lid secured with a latch, and can have a safety switch that stops the assembly in the event that the lid is opened. A control module is provided and can be located adjacent the lid above the cover. A gauge can be provided for measuring the level of the fluid, and a low solution shutoff can be provided for stopping the assembly in the event that the fluid level drops below a predetermined level. Internally, there can be an upper chamber and a lower chamber. The upper chamber is a dual use spray and immersion chamber, and can have spray manifolds therein. The lower chamber is a reservoir chamber and can (but is not required to) house a submersible pump and a heater. A seal can be provided between the upper and lower chambers. The assembly can be removed as a single unit or in segments from the container for cleaning and maintenance.

According to one advantage of the present invention, the container can be a single unitary container that houses two internal chambers. Advantageously, the plumbing between the chambers is simple.

Related, and according to another advantage of the present invention, the container can be a drum of conventional size (example 55 gallons). Such drums are commonly available, and the assembly can be adapted to connect to and fit within the standard container.

According to a still further advantage of the present invention, an overflow device is incorporated so that internal solution levels are maintained during immersion operation.

According to a still further advantage yet of the present invention, a closable lid is provided to contain spray during a spray cycle.

Related, and according to a still further advantage yet of the present invention, a safety switch that automatically stops spraying if the lid were opened during operation is provided. In this regard, safety and cleanliness is enhanced.

According to a still further advantage yet of the present invention, a low fluid shutoff is provided. The pump and heater can be automatically stopped should the fluid level drop to a level below a predetermined amount, wherein the solution can be replenished before operation of the assembly is resumed.

According to a still further advantage yet of the present invention, the assembly can be fully and easily removed from the container for cleaning and maintenance as either a single unit or in segments.

Related, and according to a still further advantage yet of the present invention, the assembly can be sold independent of the container and easily installed into an existing standard container. This allows purchasers to utilize extra containers that they may already have.

According to a still further advantage yet of the present invention, a seal is provided that affords a suitable seal between the top and bottom chambers during operation, yet allows for easy installation and removal of the assembly into and from the container.

Other advantages, benefits, and features of the present invention will become apparent to those skilled in the art upon reading the detailed description of the invention and studying the drawings.

DETAILED DESCRIPTION OF THE PREFERRED EMBODIMENTS

Figure 1:
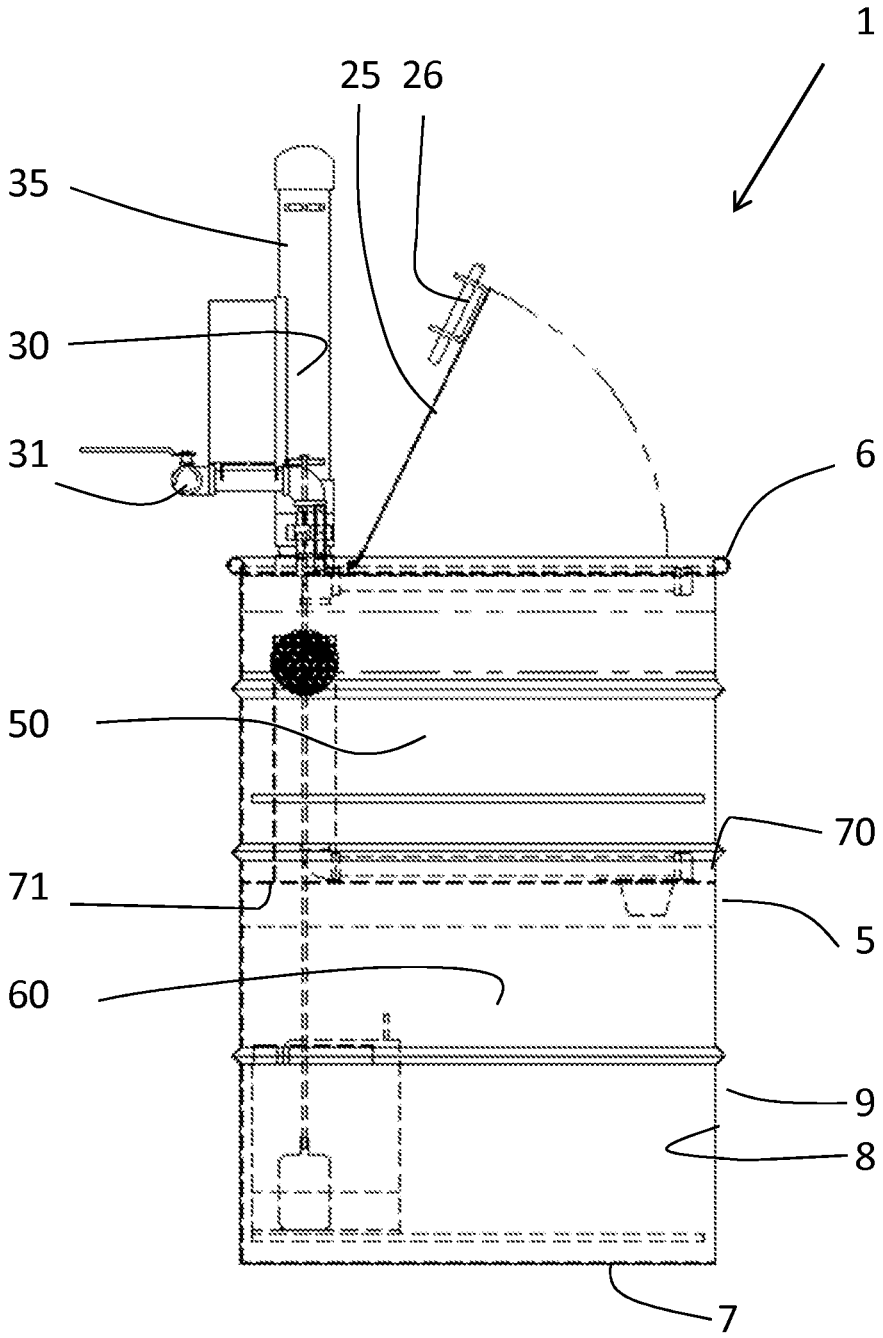
FIG. 1 is a side view of a preferred embodiment of the present invention.
Figure 2:
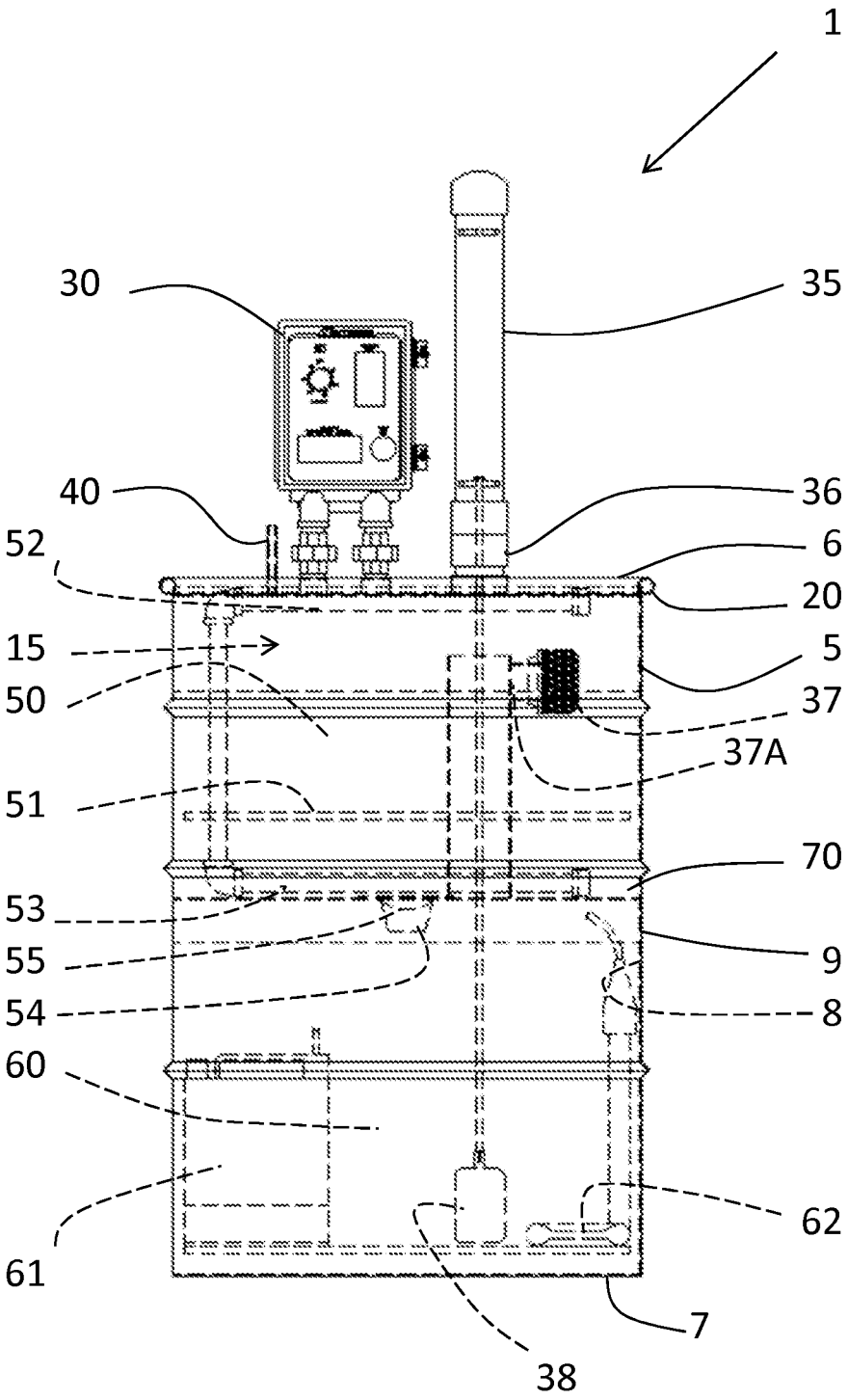
FIG. 2 is a front view of the preferred embodiment of the present invention illustrated in FIG. 1.
Figure 3:
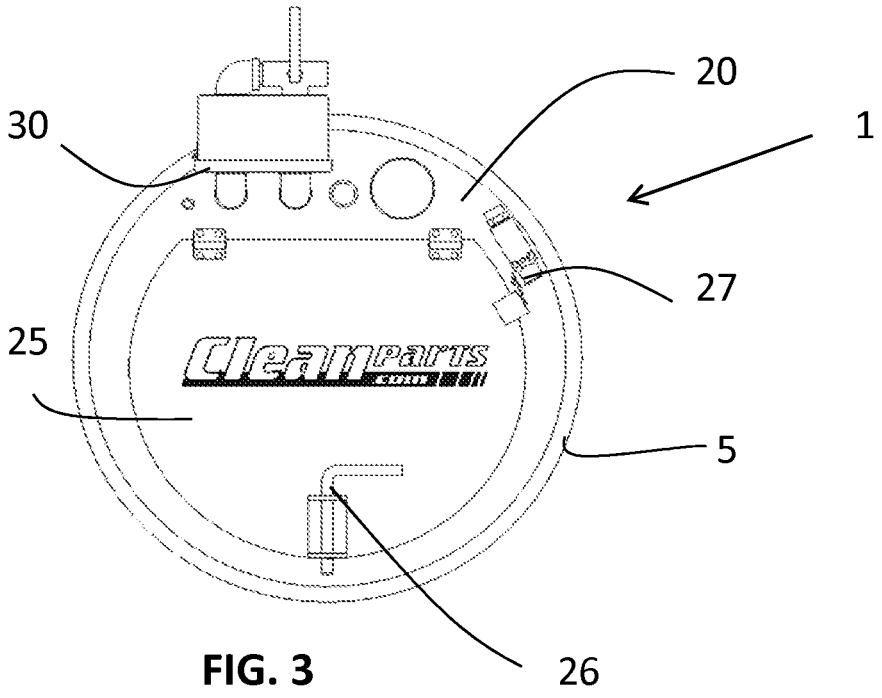
FIG. 3 is a top view of the preferred embodiment of the present invention illustrated in FIG. 1.
Figure 4:
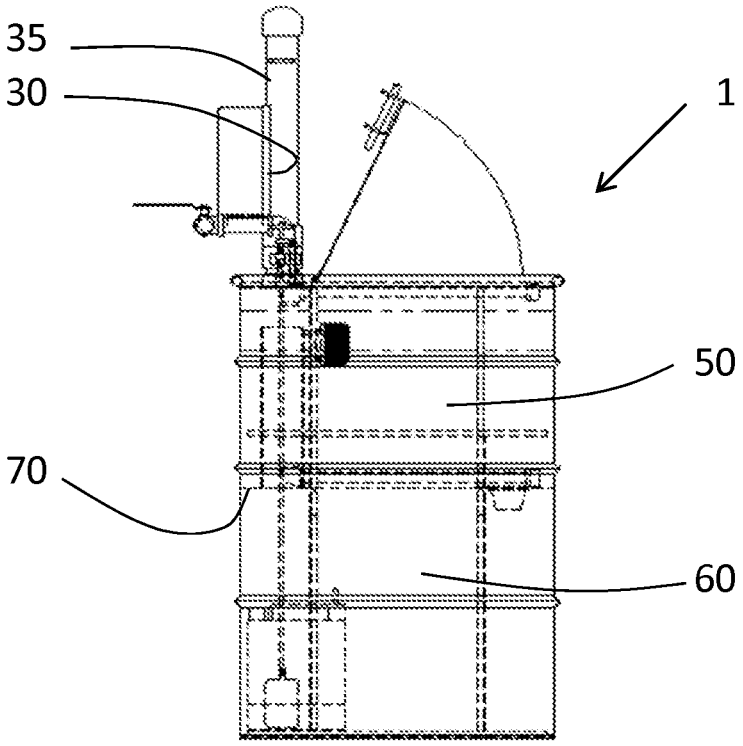
FIG. 4 is a side view of a preferred embodiment of the present invention showing the assembly fully received within the container.
Figure 5:
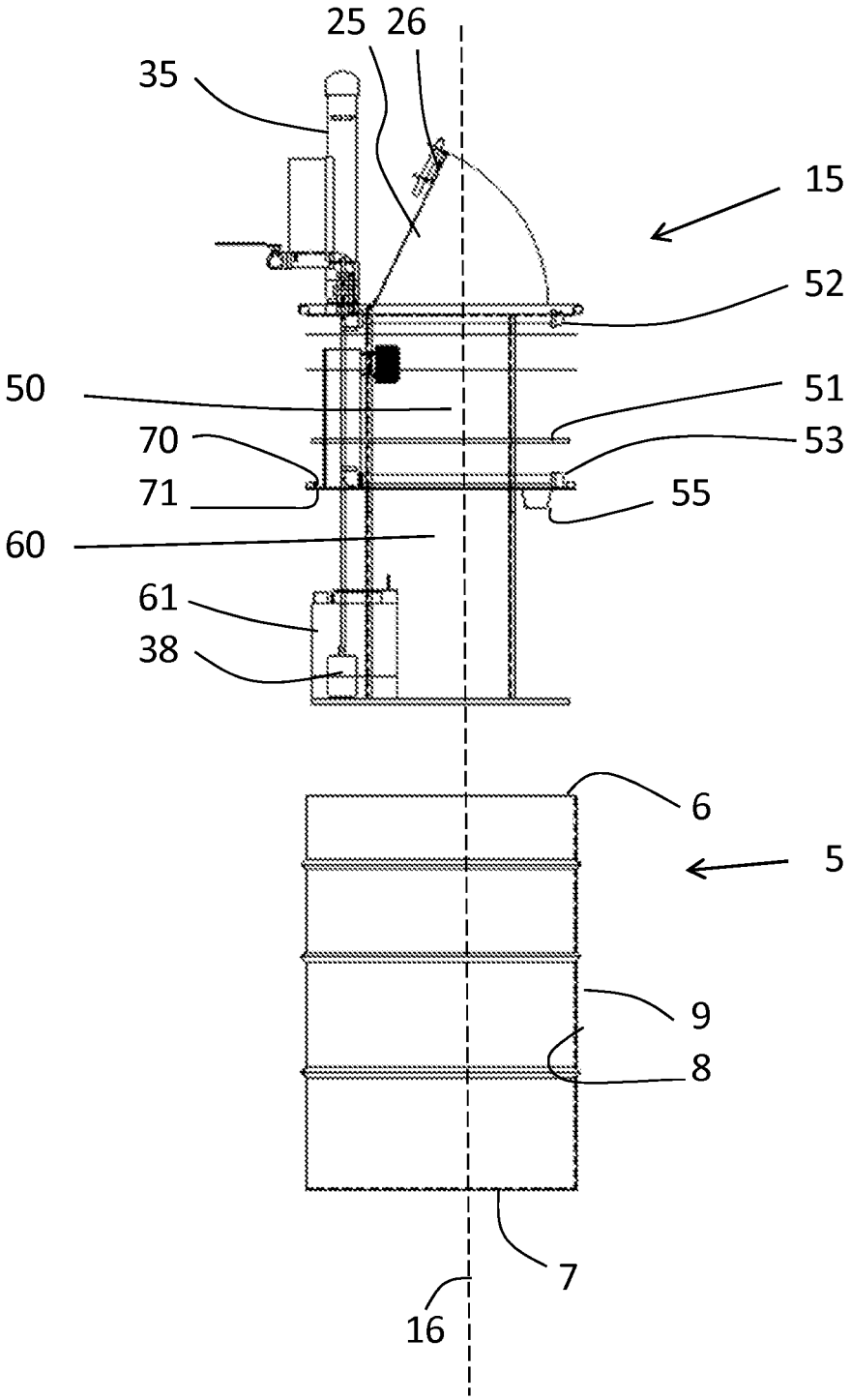
FIG. 5 is a side view of a preferred embodiment of the present invention showing the assembly fully removed from the container along an assembly longitudinal axis.

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

According to one embodiment of the present invention, and looking at FIGS. 1-6, a washer 1 comprising a container 5 and an assembly 15 is illustrated. The assembly 15 is preferably fully removable from the container 5 along a longitudinal axis 16, as described below.

One preferred embodiment of a container 5 is a standard or conventional 55 gallon drum. As such, the container 5 has top 6 and a bottom 7, an inside 8 and an outside 9. The top 6 is preferably open and the bottom 7 is preferably closed. The container 5 preferably has a generally circular cross-section, and can be made of any suitable material that is sufficiently rigid and can retain a liquid. In one embodiment, the container 5 can be a 55 gallon drum. However, it is appreciated that other drums, vessels or containers of various sizes may be used without departing from the broad aspects of the present invention.

The assembly 15 has many components, including but not limited to a drum cover 20 with a lid 25. The lid is openable and closable at the discretion of the user. A latch 26 can be provided for securing the lid 25 in a closed position. A safety switch 27 is also provided, which can detect when the lid is opened from the closed position and thus cause the washer to stop when the lid 25 is opened.

Controls 30, preferably in the form of a control module preferably sits atop the drum cover 20 adjacent the lid 25. Some of the controls include a solution heat auto-timer, a cycle timer, a temperature control and a pump out switch.

The assembly 15 also can have a pump out valve 31 useful to selectably remove fluid from the container 5. Fluid can be evacuated through the valve 31 while the container remains upright.

The assembly 15 further has a solution level gauge 35. The gauge 35 allows the user to monitor the level of solution within the washer 1. The gauge preferably extends upwards through the drum cover 20, and accordingly is easily readable by the user. A low solution shutoff 36 is further provided. One suitable location is near the bottom of the gauge, such that when the level within the washer 1, and specifically within the gauge 35, falls below a predetermined level, the shutoff 36 stops the washer to prevent damage to the assembly components. An overflow strainer 37 is further provided for preventing debris from entering the lower chamber through the overflow 37A. A level float 38 is further provided. The float 38 raises and lowers with the level of fluid within the container, and is preferably mechanically linked to communicate fluid level with the gauge 35.

A soak cycle control 40 is further provided. In one embodiment, the soak cycle control 40 is a manually operable control that functions to switch between spray and immersion cycles. It is understood that an automatic control could be used without departing from the broad aspects of the present invention.

The assembly 15 further has an upper chamber 50 and a lower chamber 60, both housed within the container 5 below the drum cover 20.

The upper chamber 50 preferably has a grate 51. Grate 51 is preferably made of grated material to allow parts to be placed thereon and allow fluid to pass through. An upper spray manifold 52 and a lower spray manifold 53 are also provided. The spray manifolds are preferably generally circular in orientation and spray generally inwardly from the perimeter of the container 5 towards parts resting on the grate 51. A strainer 54 is also provided at or near the bottom of the upper chamber 50. The upper chamber 50 can be used for spraying the parts, when the soak cycle control 40 is in a first position, and for immersing or soaking the parts when the control 40 is in a second position. When in the second respective position, the control 40 communicates with a solution stopper 55 causing it to close in order to prevent solution from returning to the lower chamber 60.

The lower chamber 60 can be a reservoir for excess fluid. The lower chamber 60 preferably contains a pump 61 and a solution heater 62. It is appreciated that while the pump 61 and heater 62 are shown to be within the lower chamber 60, that these components may be mounted externally of the container without departing from the broad aspects of the present invention.

Figure 6:
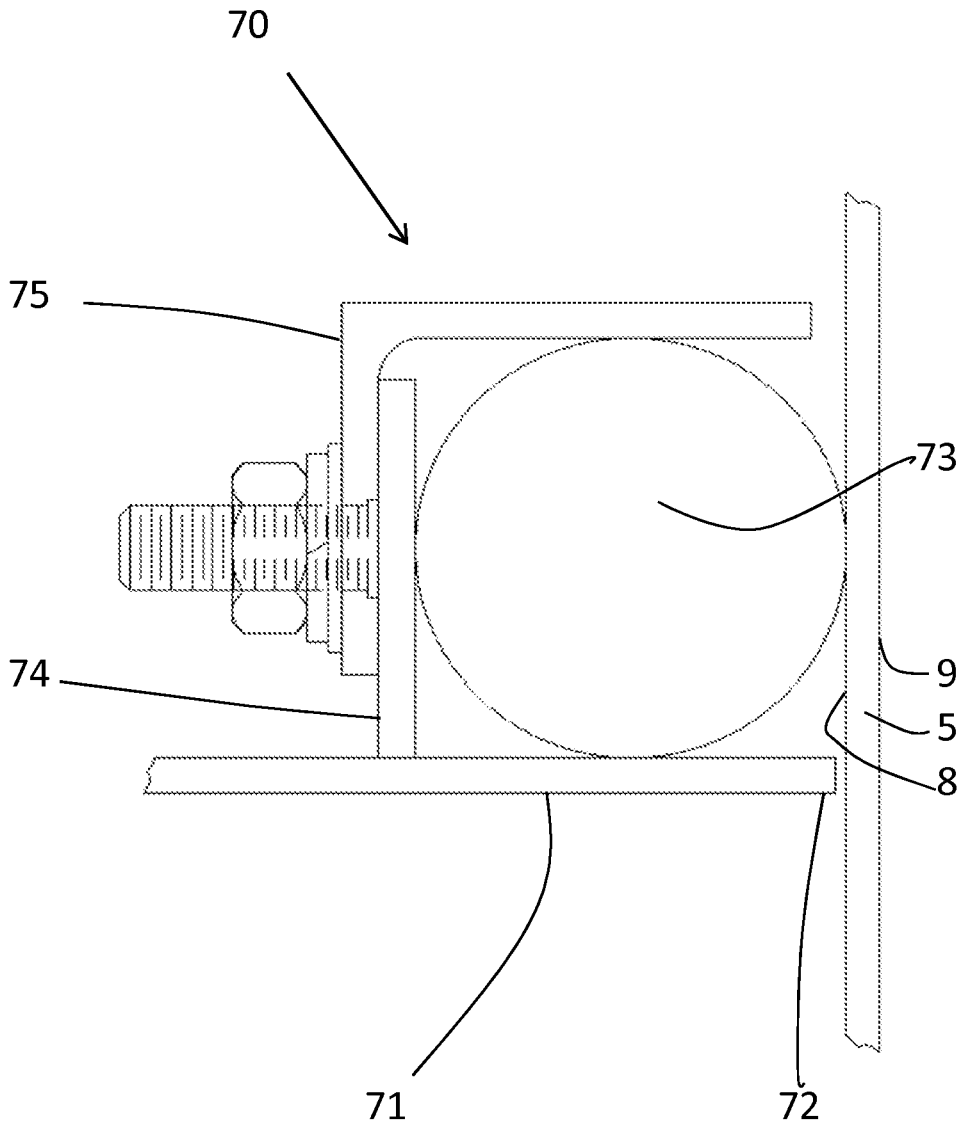
FIG. 6 is a close up partial side view of a preferred embodiment of a seal between upper and lower chambers.

A seal 70 is further provided to create a barrier between the upper chamber 50 and the lower chamber 60. The seal has base 71 with a perimeter 72 designed to be adjacent the sidewall of the container 5. A gasket 73 is provided that is conformable to the inside wall of the container to prevent fluid or solution from passing between the seal and the container, yet separable to allow the assembly 15 to be selectably inserted into and removed from the container along longitudinal axis 16. In one embodiment, as seen in FIG. 6, the gasket 73 fits between a rib 74 and the sidewall. The gasket 73 is compressed between rib 74 and container inside wall and is retractable in a plane perpendicular to the longitudinal axis 16 to make or break engagement with the side of the container. A keeper or flange 75 insures gasket 73 remains in position. It is understood that the seal may also be automatically operable without departing from the broad aspects of the present invention. It is further understood that while the keeper 75 is shown to be connectable to the rib 74, that the keeper could alternatively be connectable to the base 71 without departing from the broad aspects of the present invention. It is still further understood that the keeper 75 can (but is not required to) aid in the formation of the seal.

During use, it is seen that the container 5 is a unitary or integral container that houses two internal chambers, one preferably being directly on top of the other. Yet, it is understood that other configurations may be utilized without departing from the broad aspects of the present invention. As noted above the washer 1 is selectably operable both in an immersion cycle and a spray cycle. In the immersion cycle, parts are located on the grate 51 and solution, heated to a selected temperature, is introduced to the upper chamber 50 to a level that overcomes the parts on the grate. At the end of the immersion cycle, the user can use the soak cycle control to drain the solution to the bottom chamber. The top and bottom chamber configuration allows gravity to primarily provide the force necessary to drain the upper chamber.

During the spray cycle, nozzles connected to the upper and lower spray manifolds 52 and 53 direct solution towards the parts resting on the grate 51. The lid 25, being in a closed position, contains the solution within the upper chamber. Spray ceases if the safety switch 27 detects that the lid 25 has been opened. The heater 62 may remain operational for a predetermined period of time when the lid is opened. Alternatively, the heater 62 may shut off immediately when the lid is opened or may remain on indefinitely regardless of the open/closed status of the lid.

It is understood that the present invention is easy to assemble. Looking specifically at FIG. 5, it is seen that it is illustrated how the entire assembly 15 can be inserted into and removed from the container 5 as a single piece without disassembly or in segments.

The low fluid shutoff is preferably in communication with the pump and the heater, wherein those components are disabled in the event that solution falls below a predetermined level.

Thus it is apparent that there has been provided, in accordance with the invention, combination spray and immersion parts washer that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A combination comprising:

a container having a sidewall, a container top, a container bottom, a container inside and a container outside;

an assembly housed within said container and defining with said sidewall an upper chamber and a lower chamber, said upper chamber having a boundary defined by said sidewall and said upper chamber being fully enclosed within said container when said assembly is inserted into said container, said assembly comprising a soak cycle control with a spray cycle position and an immersion cycle position, said soak cycle control being located external of said upper chamber, said assembly further comprising a floor between said upper chamber and said lower chamber and a stopper, said upper chamber being defined by said floor and said sidewall, said stopper closing said upper chamber from said lower chamber when said soak cycle control is in said immersion cycle position, said upper chamber being a combination spray and immersion chamber for cleaning a work piece placed within said upper chamber, said upper chamber being for immersion cleaning when said soak cycle control is in said immersion cycle position and being for spray cleaning when said soak cycle control is in said spray cycle position, said assembly further comprising an upper horizontal element and a lower horizontal element, wherein said upper horizontal element, said lower horizontal element and said floor are vertically held by a plurality of vertical elements, said floor being positioned between said upper horizontal element and said lower horizontal element.

2. The combination of claim 1 wherein said container comprises a 55 gallon drum.

3. The combination of claim 1 wherein said assembly further comprises an overflow with a strainer located in said upper chamber above said floor, said strainer preventing debris from entering the overflow and returning to said lower chamber.

4. The combination of claim 1 wherein:

said combination further comprising a lid at said container top, said lid being one of closed and opened, said lid covering said upper chamber when said lid is closed, and said upper chamber comprises at least one spray manifold, wherein said at least one spray manifold ceases spraying when said lid is opened.

5. The combination of claim 4 wherein a switch is provided adjacent to said lid, said switch communicating whether said lid is open.

6. The combination of claim 1 further comprising a fluid level indicator.

7. The combination of claim 6 wherein said fluid level indicator comprises a float located within said lower chamber and a gauge outside of said lower chamber indicating the fluid level within the lower chamber.

8. The combination of claim 7 further comprising a low fluid shut off that shuts off a pump when the fluid level in said lower chamber falls below a certain level.

9. The combination of claim 8 wherein said pump is located in said lower chamber.

10. The combination of claim 9 further comprising a heater, said heater being located in said lower chamber.

11. The combination of claim 10 wherein said assembly is fully insertable and removable from said container along a vertical axis as a single unit.

12. The combination of claim 11 further comprising a strainer between said upper chamber and said lower chamber.

13. The combination of claim 12 wherein said floor has an outer floor perimeter and said assembly further comprises a seal comprising:

a seal perimeter;

a gasket;

a rib; and a base located at said outer floor perimeter, wherein said gasket extends beyond said seal perimeter between said rib and said sidewall so that fluid moving into said upper chamber cannot pass between said seal and said container.

14. The combination of claim 13 wherein said seal comprises a keeper and a gasket, said keeper insuring said gasket remains in place.

15. A combination comprising:

a cover;

a container having a sidewall, a container top, a container bottom, a container inside and a container outside;

an assembly housed within said container and defining with said sidewall an upper chamber and a lower chamber, said assembly comprising a soak cycle control with a spray cycle position and an immersion cycle position, said soak cycle control being located external of said upper chamber, said assembly further comprising a floor between said upper chamber and said lower chamber and a stopper, said floor having an outer floor perimeter, said upper chamber being defined by said floor and said sidewall, said upper chamber having a boundary defined by said sidewall, said stopper closing said upper chamber from said lower chamber when said soak cycle control is in said immersion cycle position, said upper chamber being a combination spray and immersion chamber for cleaning a work piece placed within said upper chamber, said upper chamber being for immersion cleaning when said soak cycle control is in said immersion cycle position and being for spray cleaning when said soak cycle control is in said spray cycle position, and said upper chamber and said lower chamber being selectably sealed from each other by a seal comprising:

a seal perimeter;

a gasket;

a rib; and a base located at said outer floor perimeter, wherein said gasket extends beyond said seal perimeter between said rib and said sidewall so that fluid moving into said upper chamber cannot pass between said seal and said container, and said assembly further comprising an upper horizontal element and a lower horizontal element, wherein said upper horizontal element, said lower horizontal element and said floor are vertically held by a plurality of vertical elements, said floor being positioned between said upper horizontal element and said lower horizontal element.

16. The combination of claim 15 wherein said upper chamber is fully enclosed within said container when said assembly is inserted into said container and wherein said assembly is fully insertable and removable from said container along a vertical axis as a single unit.

17. The combination of claim 15 further comprising a keeper, said keeper maintaining the position of said gasket relative said rib and said sidewall.

* * * * *